US009217599B2

(12) United States Patent
Ducharme

(10) Patent No.: US 9,217,599 B2
(45) Date of Patent: Dec. 22, 2015

(54) WATER INTRODUCTION INTO FRESH-FOOD ICEMAKER

(75) Inventor: David R. Ducharme, Anderson, SC (US)

(73) Assignee: ELECTROLUX HOME PRODUCTS, INC., Cleveland, OH (US)

( * ) Notice: Subject to any disclaimer, the term of this patent is extended or adjusted under 35 U.S.C. 154(b) by 677 days.

(21) Appl. No.: 12/712,630

(22) Filed: Feb. 25, 2010

(65) Prior Publication Data

US 2010/0218543 A1 Sep. 2, 2010

Related U.S. Application Data

(60) Provisional application No. 61/156,501, filed on Feb. 28, 2009.

(51) Int. Cl.

| | |
|---|---|
| ***F25C 1/00*** | (2006.01) |
| ***F25C 1/22*** | (2006.01) |
| ***F25D 17/06*** | (2006.01) |
| ***F25C 5/00*** | (2006.01) |
| ***F25C 5/18*** | (2006.01) |
| ***F25D 11/02*** | (2006.01) |
| ***F25D 21/04*** | (2006.01) |
| ***F25D 21/14*** | (2006.01) |
| *F25C 1/08* | (2006.01) |

(Continued)

(52) U.S. Cl.

CPC ..... *F25D 17/065* (2013.01); *F25C 5/005* (2013.01); *F25C 5/187* (2013.01); *F25D 11/022* (2013.01); *F25D 21/04* (2013.01); *F25D 21/14* (2013.01); *F25B 2700/02* (2013.01); *F25C 1/08* (2013.01); *F25C 5/08* (2013.01); *F25C 2400/10* (2013.01); *F25C 2500/06* (2013.01); *F25C 2600/04* (2013.01); *F25C 2700/12* (2013.01); *F25D 23/066* (2013.01); *F25D 2317/067* (2013.01); *F25D 2317/0651* (2013.01); *F25D 2317/0661* (2013.01); *F25D 2317/0666* (2013.01); *F25D 2317/0681* (2013.01); *F25D 2323/021* (2013.01); *F25D 2400/40* (2013.01); *F25D 2700/10* (2013.01); *Y10T 29/49826* (2015.01); *Y10T 74/2101* (2015.01); *Y10T 74/2107* (2015.01); *Y10T 137/85938* (2015.04)

(58) Field of Classification Search

CPC ..... F25C 1/22; F25C 1/225; F25C 1/24; F25C 2400/14; F25D 23/12

USPC ..... 62/347, 67, 74

See application file for complete search history.

(56) References Cited

U.S. PATENT DOCUMENTS 2,415,571 A * 2/1947 Rudolph ..... 222/133
2,846,854 A 8/1958 Galin (Continued)

*Primary Examiner* — Allana Bidder
*Assistant Examiner* — Orlando Aviles Bosques
(74) *Attorney, Agent, or Firm* — Pearne & Gordon LLP

(57) ABSTRACT

Provided is a refrigeration appliance that includes a cabinet defining a compartment for storing food items in a temperature-controlled environment. A refrigeration system is operable to provide a cooling effect to an interior of the compartment, and an ice maker is disposed within the compartment for freezing water delivered from a water source into ice pieces. A nozzle is provided in fluid communication with the ice maker for introducing the water from the water source to the ice maker. The nozzle includes an interior passage through which water is to travel when being delivered to the ice maker, and an outlet through which water being delivered to the ice maker exits the nozzle. An inside diameter of the outlet is greater than an inside diameter at another location of the interior passage.

17 Claims, 5 Drawing Sheets

(51) Int. Cl.
*F25C 5/08* (2006.01)
*F25D 23/06* (2006.01)

(56) References Cited

U.S. PATENT DOCUMENTS

| | | | | | |
|---|---|---|---|---|---|
| 3,151,776 | A | * | 10/1964 | Grimm | 222/67 |
| 3,633,374 | A | * | 1/1972 | Canter | 62/156 |
| 3,835,661 | A | | 9/1974 | Kochendorfer et al. | |
| 4,191,025 | A | * | 3/1980 | Webb | 62/135 |
| 4,635,824 | A | * | 1/1987 | Gaunt et al. | 222/129.1 |
| 4,889,316 | A | | 12/1989 | Donahue | |
| 5,065,584 | A | | 11/1991 | Byczynski et al. | |
| 5,117,646 | A | | 6/1992 | Nose et al. | |
| 5,575,833 | A | | 11/1996 | Griffin | |
| 5,755,113 | A | | 5/1998 | Ferguson et al. | |
| 5,910,159 | A | | 6/1999 | Matsuo et al. | |
| 6,041,607 | A | * | 3/2000 | Kim | 62/188 |
| 6,185,948 | B1 | | 2/2001 | Niki | |
| 6,370,908 | B1 | | 4/2002 | James | |
| 6,393,852 | B2 | | 5/2002 | Pham et al. | |
| 6,408,635 | B1 | | 6/2002 | Pham et al. | |
| 6,438,974 | B1 | | 8/2002 | Pham et al. | |
| 6,467,280 | B2 | | 10/2002 | Pham et al. | |
| 6,474,094 | B2 | | 11/2002 | Kim | |
| 6,499,305 | B2 | | 12/2002 | Pham et al. | |
| 6,662,578 | B2 | | 12/2003 | Pham et al. | |
| 6,662,583 | B2 | | 12/2003 | Pham et al. | |
| 6,679,072 | B2 | | 1/2004 | Pham et al. | |
| 6,681,596 | B2 | | 1/2004 | Kentner et al. | |
| 6,735,947 | B1 | | 5/2004 | Oh | |
| 6,735,974 | B2 | * | 5/2004 | Oh | 62/347 |
| 7,121,109 | B2 | | 10/2006 | Heims | |
| 7,143,588 | B2 | * | 12/2006 | Cole | 62/74 |
| 7,159,406 | B2 | | 1/2007 | Schuchart | |
| 7,237,395 | B2 | | 7/2007 | Rafalovich et al. | |
| 7,389,649 | B2 | | 6/2008 | Pham et al. | |
| 2004/0148957 | A1 | * | 8/2004 | Pohl et al. | 62/347 |
| 2006/0112715 | A1 | * | 6/2006 | Chung | 62/340 |
| 2006/0218961 | A1 | * | 10/2006 | Kim et al. | 62/344 |
| 2006/0260346 | A1 | | 11/2006 | Coulter et al. | |
| 2007/0257138 | A1 | * | 11/2007 | Riese | 239/589 |
| 2008/0053138 | A1 | * | 3/2008 | Ryu et al. | 62/344 |
| 2008/0258597 | A1 | * | 10/2008 | Kwon et al. | 312/405.1 |

* cited by examiner

WATER INTRODUCTION INTO FRESH-FOOD ICEMAKER

CROSS-REFERENCE TO RELATED APPLICATIONS

This application claims the benefit of U.S. Provisional Application No. 61/156,501, filed Feb. 28, 2009, which is incorporated in its entirety herein by reference.

BACKGROUND OF THE INVENTION

1. Field of the Invention

The present invention is directed generally to a refrigeration appliance and, more particularly, to a refrigeration appliance including a nozzle for introducing water into an ice maker located within a fresh-food compartment of the refrigeration appliance.

2. Description of Related Art

Modern refrigeration appliances commonly include an automatic ice maker that is operable to make ice without requiring a user to manually fill ice trays. A water hose is installed between a water source and an inlet to the ice maker to deliver fresh water for filling an ice mold within the ice maker. The refrigeration appliance is also commonly provided with a valve to regulate the flow of water being delivered into the ice mold to be frozen into individual ice pieces.

An end of the water hose closest to the ice maker is occasionally subjected to sub-freezing temperatures present within the ice maker. Any residual water at that end of the water hose, if subjected to the sub-freezing temperature for a prolonged period of time, could freeze and interfere with the delivery of water into the ice maker.

Accordingly, there is a need in the art for a refrigeration appliance equipped with a conduit for delivering water to an ice maker that minimizes the accumulation of frozen water that could potentially interfere with the delivery of water to the ice maker.

BRIEF SUMMARY OF THE INVENTION

According to one aspect, the present invention involves a refrigeration appliance that includes a cabinet defining a compartment for storing food items in a temperature-controlled environment. A refrigeration system is operable to provide a cooling effect to an interior of the compartment, and an ice maker is disposed within the compartment for freezing water delivered from a water source into ice pieces. A nozzle is provided in fluid communication with the ice maker for introducing the water from the water source to the ice maker. The nozzle includes an interior passage through which water is to travel when being delivered to the ice maker, and an outlet through which water being delivered to the ice maker exits the nozzle. An inside diameter of the outlet is greater than an inside diameter at another location of the interior passage.

According to another aspect, the present invention provides a refrigeration appliance including a cabinet defining a fresh-food compartment for storing food items in a temperature-controlled environment having a fresh-food target temperature above 0° C. and a freezer compartment for storing food items in a temperature-controlled environment having a freezer target temperature that is less than 0° C. The freezer compartment is disposed vertically beneath the fresh-food compartment. A refrigeration system is operable to provide a cooling effect to an interior of the fresh-food and freezer compartments, and an ice maker is disposed within the fresh-food compartment for freezing water delivered from an external water source into ice pieces. A nozzle is provided in fluid communication with the ice maker for introducing the water from the external water source to the ice maker, and includes an interior passage extending through a ceiling portion of the cabinet to transport the water from the external water source into the cabinet to be delivered to the ice maker. The nozzle also includes an outlet through which water being delivered to the ice maker exits the nozzle. The outlet is supported at an elevation within the cabinet that is vertically above the ice maker, and an inside diameter adjacent to the outlet is greater than an inside diameter adjacent to a location of the interior passage of the nozzle and a circumference of the outlet forms an angle other than perpendicular relative to a bulk fluid flow direction in which the water is to travel as the water exits the nozzle.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION OF ILLUSTRATIVE EMBODIMENTS

Figure 1:
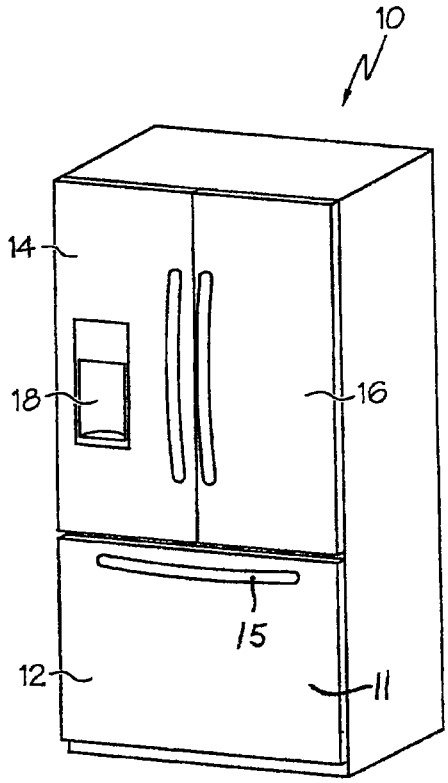
FIG. 1 is a perspective view showing an illustrative embodiment of a refrigeration appliance.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

FIG. 1 shows an illustrative embodiment of a refrigeration appliance 10. The refrigeration appliance 10 shown in FIG. 1 is a so-called bottom-mount refrigerator, where a fresh-food compartment 20 (FIG. 2) is disposed vertically above a freezer compartment 24. A pair of French doors 14, 16 restrict access to an interior of the fresh-food compartment 20 and are pivotally coupled with hinges to opposite lateral sides of a cabinet 22 housing the fresh-food compartment 20. A dispenser 18 can optionally be provided to one of the doors 14, 16 to dispense at least one of water and ice from the refrigeration appliance 10 without requiring the doors 14, 16 to be opened. Ice dispensed through the dispenser 18 can be made by, and delivered from an ice maker 26 (FIG. 2) disposed within the fresh food compartment 20 of the refrigeration appliance 10. Likewise, water dispensed through the dispenser 18 can optionally be filtered by a water filter 27 (FIGS. 4 and 5) disposed within the fresh food compartment 20 of the refrigeration appliance 10.

A freezer door 12 is coupled to a wire basket disposed within an insulated freezer compartment 24 and is arranged vertically beneath the fresh food compartment 20. A handle 15 is provided to an external side of the freezer door 12 to be grasped by a user and pulled outwardly to at least partially extract the freezer basket from within the freezer compartment 24, thereby making the contents of the freezer basket accessible. The freezer basket can be slidably mounted within the freezer compartment 24 with ball-bearing drawer slides such as those manufactured by Accuride International Inc., of Santa Fe Springs, Calif. Pulling the handle 15 will move the freezer door 12 outwardly away from the freezer compartment 24 and cause the freezer basket to travel along a track defined by the slide rails to it least partially expose the contents of the freezer basket.

Figure 2:
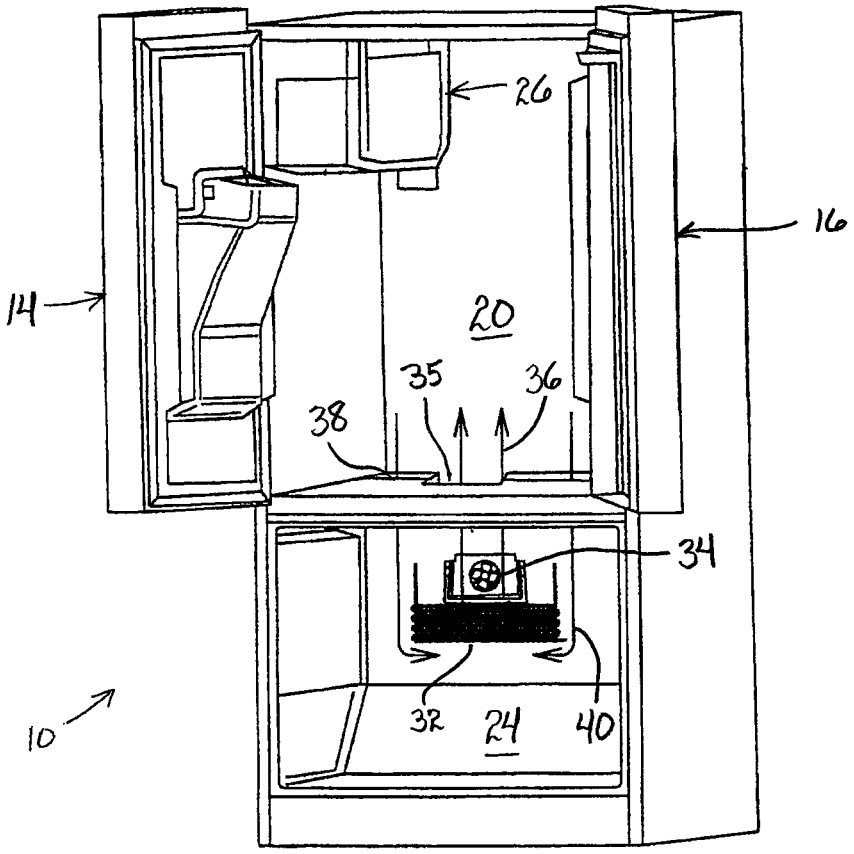
FIG. 2 is a perspective view showing an illustrative embodiment of an interior of a fresh food compartment including an ice maker, and a freezer compartment of a refrigeration appliance, wherein a fresh food door and a freezer door have been removed to expose the interior of those compartments.

As shown in FIG. 2, a system evaporator 32 is exposed to, and in thermal communication with the interior of the freezer compartment 24. Refrigerant flowing through the system evaporator 32 cools air being blown over the system evaporator 32 by a circulation fan 34 to be introduced into the fresh food compartment 20 and the freezer compartment 24. The cool air is blown upward through an air duct 35 formed in the insulation and extending between the fresh food and freezer compartments 20, 24 in the direction of arrows 36 to provide a cooling effect to the fresh food compartment 20. Air circulated through the fresh food compartment 20 can be returned to the freezer compartment 24 through a pair of return ducts 38 also extending between the fresh food and freezer compartments 20, 24 in the direction of arrows 40. The cool air from the system evaporator 32 is circulated as needed to maintain the refrigerated environment within the fresh food compartment 22 within an acceptable tolerance of a target temperature that is lower than room temperature but above zero degrees Centigrade. The cool air also maintains temperature was in the freezer compartment 24 within an acceptable tolerance of a target temperature that is less than zero degrees Centigrade.

The ice maker 26 includes an ice mold for receiving water to be frozen into ice pieces. The ice maker 26 can optionally include an ice chamber evaporator for providing a suitable cooling effect to freeze the water using refrigerant from a compressor that also supplies the system evaporator 32. According to an alternate embodiment of the ice maker 26, the ice maker 26 also includes ice making evaporator for cooling elongated freezing fingers to which ice pieces will freeze. At least a portion of the fingers will be submerged within water, and an external temperature of the fingers lowered to a sub-freezing temperature by the refrigerant flowing through the ice making evaporator. Ice pieces frozen to the fingers are to be deposited within an ice bucket. An example of such an ice maker embodiment is described in U.S. Provisional Patent Application Ser. No. 61/156,501, which is incorporated in its entirety herein by reference. Regardless of the specific ice maker configuration, a temperature within the ice maker, at least temporarily, falls below zero degrees Centigrade.

Although the refrigeration appliance 10 has been described above is including both a fresh food compartment 20 and a freezer compartment 24, the refrigeration appliance 10 described herein is not so limited. Instead, alternate environments can include only a fresh food compartment 20, or only a freezer compartment 24, for example. Further, the illustrative examples discussed herein include an icemaker 26 disposed within the fresh food compartment, but alternate embodiments can include an icemaker disposed within any refrigerated compartment for freezing water into individual ice pieces, such as by freezing water in a tray through convection. However, for the sake of brevity the illustrative example discussed in detail below includes an icemaker 26 disposed within the fresh food compartment 20.

Figure 3:
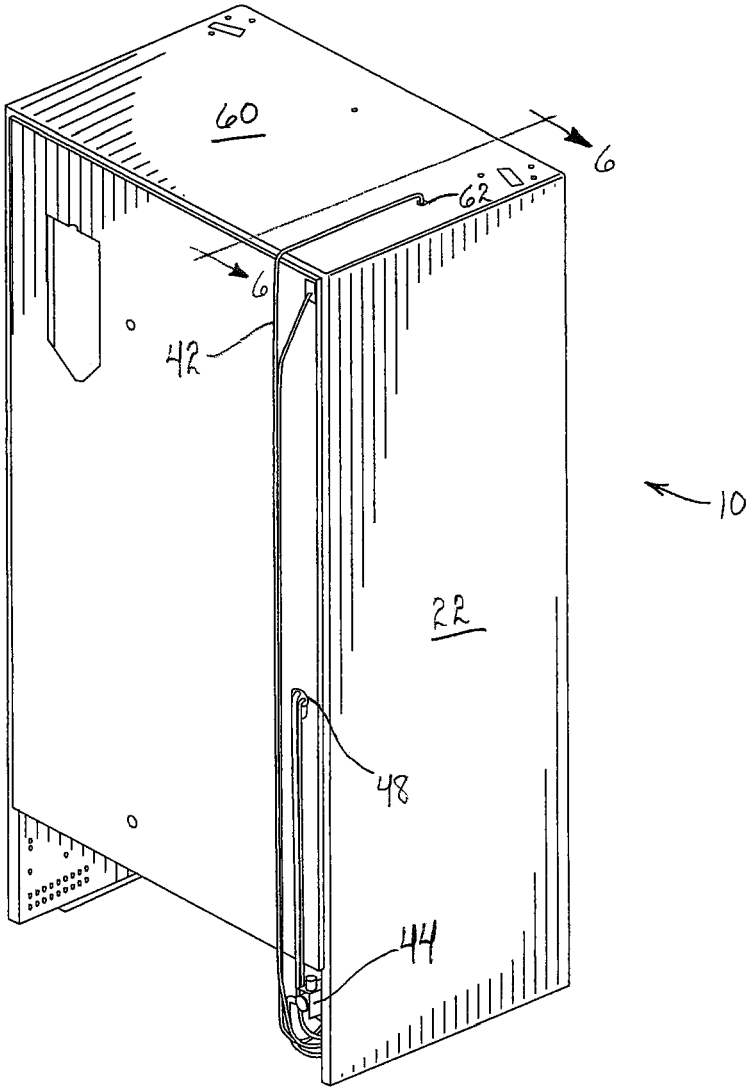
FIG. 3 is a perspective view showing an illustrative embodiment of a rear portion of a refrigeration appliance including a water hose introduced to an interior of a cabinet of the refrigeration appliance through a top portion of the cabinet.

The icemaker 26 can be an automatic icemaker, which is operable to freeze water into ice without user intervention. During an ice making cycle, water to be frozen into ice pieces is to be introduced to the ice maker through a water hose 42 as shown in FIG. 3. The water hose 42 is a conduit made of plastic or any other suitable material, and can extend between an external water source and the ice maker outside of the cabinet 22 as shown to facilitate installation of the refrigeration appliance 10 upon being delivered. The external water source can be a residential or other water supply line commonly included in residential dwellings, a water filter 27 provided to the refrigeration appliance 10, for example, or any other water supply that is external of the icemaker 26. For the sake of brevity and clearly describing the refrigeration appliance 10, however, the illustrative embodiments are described below with reference to the water filter 27 as the external water source.

Figure 4:
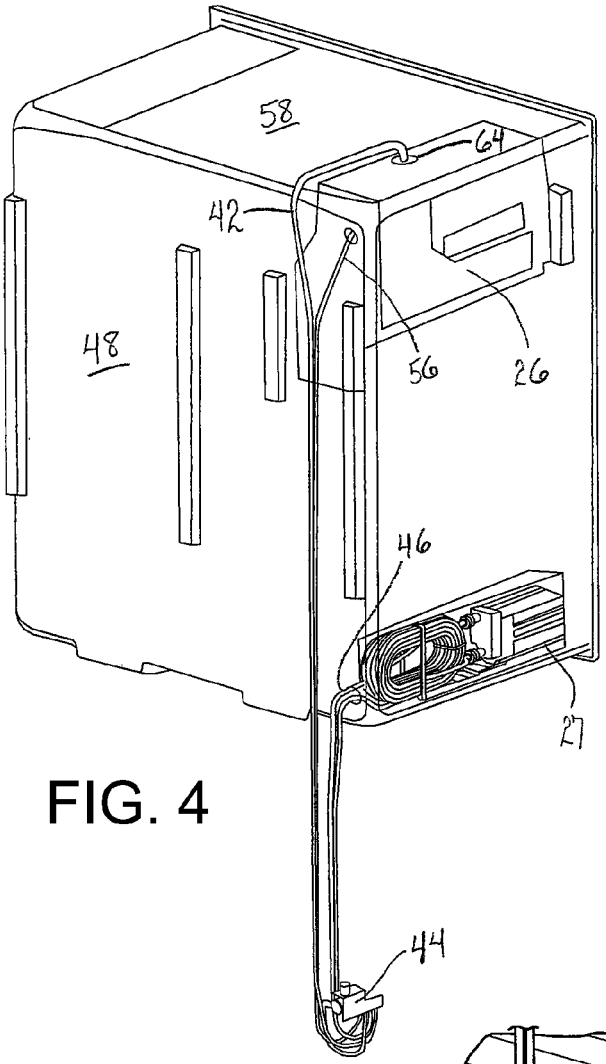
FIG. 4 is a partially cutaway view showing an illustrative embodiment of a liner of a fresh food compartment including an aperture receiving a water hose for delivering water to an ice maker within the fresh food compartment.

A water valve 44 can also be provided to control the delivery of water to the icemaker 26 via the water hose 42. The water valve 44 can be a solenoid valve or any other electrically, magnetically, pneumatically, hydraulically or otherwise actuated valve for selectively delivering water to the icemaker 26. As shown in FIGS. 3 and 4 the water valve 44 is disposed between the water filter 27 and the icemaker 26 disposed within the fresh food compartment 20. A water line of a residential dwelling, for example, is to be connected to the water valve 44, from where the water is introduced to the water filter 27 via a supply hose 46. The supply hose 46 extends through an aperture 48 (FIG. 3) formed in the cabinet 22 and an aligned aperture 50 (FIG. 5) formed in a liner 48 that is to be housed within the cabinet 22 and insulated by foam insulation (not shown) to define the fresh food compartment 20.

Filtered water exiting the water filter 27 is returned to the water valve 44 via a filtered water hose 52, from where the filtered water can be selectively delivered to the icemaker 26. Operation of the water valve 44 can optionally be controlled by a microprocessor executing computer-executable instructions in coordination with ice making processes.

Figure 5:
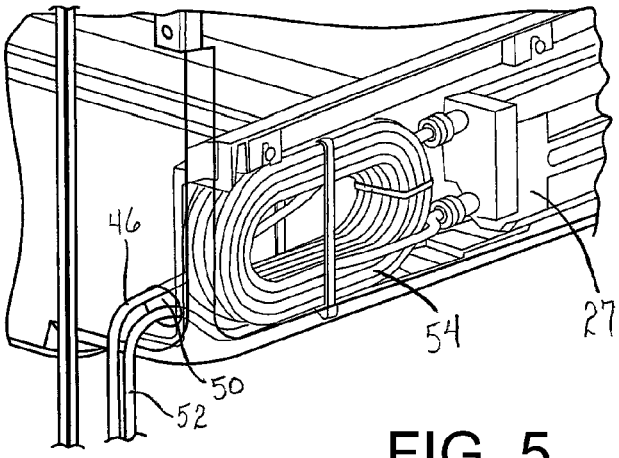
FIG. 5 is a magnified view of a water filter and a coiled segment of the water hose shown in FIG. 4 for storing water in a refrigerated environment.

A segment of the filtered water hose 52 can optionally be formed into a coil 54, as shown in FIG. 5, and the coil can be exposed to a refrigerated temperature such as that within the fresh food compartment 20. The coil 54 and/or the water filter 27 can optionally be separated from the interior of the fresh food compartment 20, but are exposed to temperatures established by the cooling effect provided by the refrigeration system of the refrigeration appliance 10. The coil 54 formed by the segment of the filtered water hose 52 can store a volume of refrigerated and filtered water suitable to supply the icemaker 26 via water hose 42 and the optional water dispenser through one of the doors 14, 16 via a dispenser hose 56. The volume stored by the coil 54 can optionally be sufficient to fill the ice mold of the icemaker 26 for at least one ice making cycle.

Water from the water hose 42 can be delivered to the icemaker 26 through a nozzle 66 (FIG. 6) extending at least partially through a ceiling portion 58 of the liner 48, and/or through a ceiling portion 60 of the cabinet 22 of the refrigeration appliance 10. As shown in FIG. 3, the water hose 42 extends along the external surface of the cabinet 22 between the water valve 44 and an aperture 62 through which water is to be introduced into the icemaker 26. A similar aperture 64 formed in the ceiling portion 58 of the liner 48 for the fresh food compartment 20 is substantially aligned with the aperture 62 formed in the cabinet 22 when the liner 48 is installed in the cabinet 22. According to alternate embodiments, the water hose 42 can be installed between the liner 48 and the cabinet 22.

Figure 6:
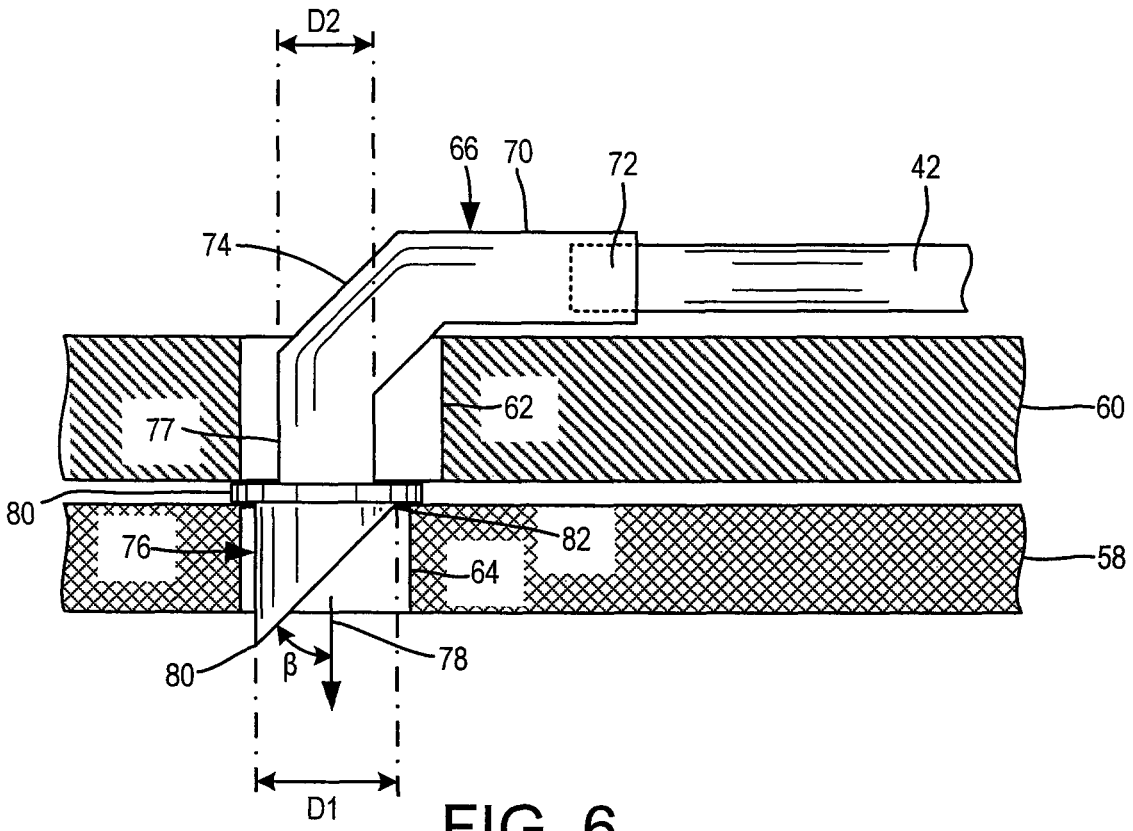
FIG. 6 is a partially cutaway view of a nozzle extending through a cabinet of a refrigeration appliance between a water hose and an ice maker.

As shown in FIG. 6, the nozzle 66 defines an interior passage extending at least partially through the aperture 62 in the ceiling portion 60 of the cabinet 22 to introduce water from the water valve 44 into the cabinet 22 to be delivered to the icemaker 26. The aperture 62 can optionally be filled with insulation material, a sealant material, and the like, to secure the nozzle 66 in place. The nozzle 66 can be formed from a plastic or other suitable material with a relative low thermal conductivity. According to alternate embodiments, the nozzle 66 can be integrally formed as a portion of the water hose 42 that is to extend between the external water source and a water inlet port of the ice maker. According to yet other embodiments, the nozzle 66 can be integrally formed as a portion of the water hose 42 extending between a water inlet port of the icemaker 26 and a water inlet port of the water valve 44.

For the embodiment shown in FIG. 6, the nozzle 66 includes a relatively straight connector portion 70 that extends along said ceiling portion 60 of said cabinet 22 for receiving a leading portion 72 of the water hose 42 to couple the water hose 42 to the nozzle 66 in a substantially leak-free manner. A transitional portion 74 of the nozzle 66 provides a gradual change of direction to water flowing through the nozzle 66 from the connector portion 70 towards an outlet 76. A substantially vertical portion 77 of the nozzle extends to a radially-extending flange 80 that cooperates with an underside of the ceiling portion 60 to interfere with removal of the nozzle 66 from the refrigeration appliance 10.

Water exits the nozzle 66 through the outlet 76, which is separated from the substantially-vertical portion 77 by the flange 80. The outlet is supported at an elevation within the cabinet 22 that is substantially vertically above an inlet port of the ice maker 26 through which water is to be supplied to the ice mold of the ice maker to be frozen into ice pieces. An inside diameter D1 of the nozzle 66 at the outlet 76 is greater than an inside diameter D2 at another location along the interior passage of the nozzle 66. For example, the inside diameter D1 at the outlet 76 can be greater than the inside diameter D2 of the nozzle adjacent to the connector portion 70, which acts as a water inlet into the nozzle 66. According to another example, the inside diameter D1 at the outlet 76 can be greater than the inside diameter D2 at all other locations along the interior passage of the nozzle 66, including the substantially-vertical portion 77, the transitional portion 74 and the connector portion 70. The larger interior diameter D1 at the outlet 76 relative to the diameter elsewhere along the interior passage defined by the nozzle 66 minimizes water retention at the outlet 76 due to the surface tension of the water.

A circumference of the outlet 76 can optionally form an angle β other than perpendicular relative to a bulk fluid flow direction in which the water travels as it exits the nozzle 66, a direction indicated by arrow 78. For example, the angle β is an acute angle that is approximately 45° in FIG. 6, although any desired angle other than perpendicular to the bulk fluid flow direction 80 can optionally be employed.

For embodiments including the angled circumference, a first portion of the circumference, such as a peak region 80, is supported at a vertical elevation within the cabinet 22 that is lower than a second portion of the circumference, such as a base region 82. The peak region 80 can be disposed adjacent to a water inlet of the icemaker 26, and exposed to an icemaker temperature that is below 0° C. However, due to the lack of water retention due to the configuration of the nozzle 66, interference with the introduction of water to the icemaker 26 due to ice formation is minimized.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention.

What is claimed is:

1. A refrigeration appliance comprising:

a cabinet defining a compartment for storing food items in a temperature-controlled environment;

a refrigeration system that is operable to provide a cooling effect to an interior of the compartment;

an ice maker disposed within the compartment adjacent to a ceiling of the compartment and comprising an ice maker housing enclosing components for freezing water delivered from an external water source into ice pieces, wherein a sub-freezing temperature is established within the ice maker; and a nozzle extending from outside of the cabinet to the ice maker within the cabinet for introducing the water from the external water source to the ice maker, wherein the nozzle comprises:

an inlet coupled to an end of a water hose that supplies water to the nozzle, an interior passage through which water is to travel when being delivered to the ice maker, and an outlet located vertically below the inlet at a terminal end of the nozzle opposite the inlet, the outlet including a region that is terminated at an elevation vertically above the ice maker housing, wherein the water being delivered to the ice maker exits the nozzle through the outlet and enters the environment of the sub-freezing temperature within the ice maker where the water is to be frozen, wherein an inside diameter of the outlet in a plane perpendicular to a bulk fluid flow direction is greater than an inside diameter at another location of the interior passage.

2. The refrigeration appliance according to claim 1, wherein a circumference of the outlet of the nozzle forms an angle other than perpendicular relative to the bulk fluid flow direction in which the water is to travel as the water exits the nozzle.

3. The refrigeration appliance according to claim 2, wherein the another location of the interior passage is adjacent to an inlet of the nozzle.

4. The refrigeration appliance according to claim 1, wherein the inside diameter of the outlet is greater than the inside diameter at all locations along the interior passage.

5. The refrigeration appliance according to claim 1, wherein the inlet is exposed externally of the cabinet of the refrigeration appliance.

6. The refrigeration appliance according to claim 5, wherein a circumference of the outlet forms an angle other than perpendicular relative to the bulk fluid flow direction in which the water travels as the water exits the nozzle, and a first portion of the circumference is supported at a vertical elevation within the cabinet of the refrigeration appliance that is lower than a second portion of the circumference.

7. The refrigeration appliance according to claim 6, wherein the first portion of the circumference is disposed adjacent to a portion of the ice maker where the first portion is exposed to an ice-maker temperature that is below 0° C.

8. The refrigeration appliance according to claim 1, wherein the compartment is a fresh-food compartment for storing food items in a temperature-controlled environment having a fresh-food target temperature above 0° C., and the ice maker is disposed within the fresh-food compartment adjacent to a ceiling of the fresh-food compartment.

9. The refrigeration appliance according to claim 8 further comprising a freezer compartment for storing food items in a temperature-controlled environment having a freezer target temperature that is less than 0° C., wherein the freezer compartment is disposed vertically beneath the fresh-food compartment.

10. The refrigeration appliance according to claim 1, wherein the nozzle is integrally formed as a portion of a water hose that is to extend between the water source and a water inlet port of the ice maker.

11. The refrigeration appliance according to claim 1, wherein the nozzle is integrally formed as a portion of the water hose extending between a water inlet port of the ice maker and an inlet exposed to an external portion of the refrigeration appliance.

12. A refrigeration appliance comprising:

a cabinet housing a liner defining a fresh-food compartment for storing food items in a temperature-controlled environment having a fresh-food target temperature above 0° C. and a freezer compartment for storing food items in a temperature-controlled environment having a freezer target temperature that is less than 0° C., wherein the freezer compartment is disposed vertically beneath the fresh-food compartment;

a refrigeration system that is operable to provide a cooling effect to an interior of the fresh-food and freezer compartments;

an ice maker disposed within the fresh-food compartment adjacent to a top portion of the fresh-food compartment, the ice maker including a housing defining a compartment in which water delivered from an external water source is to be frozen into ice pieces; and a nozzle in fluid communication with the ice maker for introducing the water from the external water source to the ice maker, wherein the nozzle comprises:

an inlet coupled to an end of a water hose that supplies water to the nozzle;

an interior passage extending from a location external to the cabinet through a ceiling portion of the cabinet along the top portion of the fresh food compartment to transport the water from the external water source through the top portion and into the fresh-food compartment housed by the cabinet to be delivered to the ice maker, and a vertical region comprising an outlet defining a vertically-oriented interior passage through which water being delivered to the ice maker exits the nozzle, the outlet being located vertically below the inlet at a terminal end of the nozzle opposite the inlet, and comprising a portion terminated at an elevation within the cabinet that is vertically above the housing of the ice maker, wherein an inside diameter of the outlet in a first plane perpendicular to a bulk fluid flow direction is greater than an inside diameter of a second plane perpendicular to the bulk fluid flow direction at a location along the vertical region of the nozzle, and a circumference of the outlet forms an angle other than perpendicular relative to the bulk fluid flow direction in which the water is to travel as the water exits the nozzle.

13. The refrigeration appliance according to claim 12, wherein the outlet is at least occasionally subjected to a temperature below 0° C. at the elevation within the cabinet vertically above the ice maker.

14. The refrigeration appliance according to claim 12, wherein the nozzle is integrally formed as a portion of the water hose that is to extend between the external water source and a water inlet port of the ice maker.

15. The refrigeration appliance according to claim 12, wherein the nozzle is integrally formed as a portion of the water hose extending between a water inlet port of the ice maker and an inlet exposed to an external portion of the refrigeration appliance.

16. The refrigeration appliance according to claim 12, wherein the nozzle further comprises a transversely-extending flange arranged along the vertical region, wherein the transversely-extending flange cooperates with an underside of the ceiling portion of the cabinet for interfering with outward removal of the nozzle through the ceiling portion of the cabinet.

17. The refrigeration appliance according to claim 1 further comprising a filter disposed within the compartment to filter the water introduced to the ice maker through the nozzle.

* * * * *